US012595754B2

(12) United States Patent
Izawa et al.

(10) Patent No.: US 12,595,754 B2
(45) Date of Patent: Apr. 7, 2026

(54) SLIDING MEMBER AND INTERNAL COMBUSTION ENGINE

(71) Applicants: Nissan Motor Co., Ltd., Yokohama (JP); Fukuda Metal Foil & Powder Co., Ltd., Kyoto (JP)

(72) Inventors: Yoshinori Izawa, Kanagawa (JP); Katsunori Otobe, Kyoto (JP)

(73) Assignees: Nissan Motor Co., Ltd., Yokohama (JP); Fukuda Metal Foil & Powder Co., Ltd., Kyoto (JP)

( * ) Notice: Subject to any disclaimer, the term of this patent is extended or adjusted under 35 U.S.C. 154(b) by 0 days.

(21) Appl. No.: 18/866,629

(22) PCT Filed: Apr. 25, 2023

(86) PCT No.: PCT/JP2023/016255
§ 371 (c)(1),
(2) Date: Nov. 18, 2024

(87) PCT Pub. No.: WO2023/223782
PCT Pub. Date: Nov. 23, 2023

(65) Prior Publication Data

US 2025/0243792 A1 Jul. 31, 2025

(30) Foreign Application Priority Data

May 19, 2022 (JP) ..... 2022-082053

(51) Int. Cl.
*F01L 3/02* (2006.01)

(52) U.S. Cl.
CPC ..... *F01L 3/02* (2013.01); *F01L 2301/00* (2020.05)

(58) Field of Classification Search
CPC ..... F01L 2301/00; F01L 3/02
See application file for complete search history.

(56) References Cited

U.S. PATENT DOCUMENTS

| | | | | |
|---|---|---|---|---|
| 2004/0003878 | A1 | 1/2004 | Izumi et al. | |
| 2021/0310401 | A1* | 10/2021 | Nou | F01L 3/20 |
| 2022/0162968 | A1* | 5/2022 | Wilson | B23K 35/302 |
| 2024/0068076 | A1* | 2/2024 | Morgenstern | F02F 3/0084 |

FOREIGN PATENT DOCUMENTS

| | | | |
|---|---|---|---|
| EP | 3831516 | A1 | 6/2021 |
| JP | H06228682 | A | 8/1994 |
| JP | 2008144253 | A | 6/2008 |
| JP | 6519962 | B2 | 6/2019 |
| WO | 2020/026604 | A1 | 2/2020 |

OTHER PUBLICATIONS

Notice of Reasons for Refusal received for JP Application No. 2024-521639, mailed on Sep. 25, 2025, 6 pages.
Extended European Search Report received for EP Application No. 23805862.2, mailed on Aug. 27, 2025, 11 pages.

* cited by examiner

*Primary Examiner* — Kevin A Lathers
(74) *Attorney, Agent, or Firm* — Spencer Fane LLP

(57) ABSTRACT

A sliding member is provided with a sliding film at least on a surface of the sliding member. The sliding film contains copper-based alloy particles including titanium and has a titanium oxide layer in part of an interface between the particles forming the sliding film. The titanium content of the copper-based alloy particles is 3.5 mass % or more and 11.0 mass % or less. The sliding member is part of an internal combustion engine.

8 Claims, 3 Drawing Sheets

SLIDING MEMBER AND INTERNAL COMBUSTION ENGINE

CROSS-REFERENCE TO RELATED APPLICATIONS

This application is a U.S. national stage application of International PCT/JP2023/016255, filed on Apr. 25, 2023, which claims priority to Japanese Application No. 2022-082053, filed on May 19, 2022.

BACKGROUND

Technical Field

The present invention relates to a sliding member and an internal combustion engine, and more specifically, to a sliding member capable of achieving excellent high-temperature wear resistance and an internal combustion engine provided with the sliding member.

Background Information

Japanese Patent No. 6,519,962 (Patent Document 1) discloses a conventional valve seat of an internal combustion engine to which is applied a sliding member formed by spraying precipitation-hardened copper alloy particles, such as Cu-3Ni-0.7Si, onto a base material. In this precipitation-hardened copper alloy, Si is included to generate $Ni_2Si$ for precipitation strengthening, and a thin oxide film formed thereon can reduce adhesive wear.

SUMMARY

However, when a sliding member as described in Patent Document 1 is applied to the exhaust-side valve seat of an internal combustion engine exposed to high-temperature gases exceeding 1000° C., for example, it can be seen that there is room for improvement of the high-temperature wear resistance.

The present invention was devised in view of such a problem of the prior art, and has as an object to provide a sliding member capable of achieving excellent high-temperature wear resistance, and an internal combustion engine provided with the sliding member.

Having undertaking diligent study to achieve the above object, the inventors found that the above-mentioned object can be realized by a prescribed sliding film containing copper-based alloy particles including titanium and having a titanium oxide layer at part of the interface between the particles forming the sliding film, which led to the completion of the present invention.

That is, the sliding member of the present invention is provided with a sliding film at least on the surface. The sliding film contains copper-based alloy particles including titanium and has a titanium oxide layer at part of the interface between the particles forming the sliding film. The titanium content of the copper-based alloy particles is 3.5 mass % or more and 11.0 mass % or less.

Further, the internal combustion engine of the present invention is provided with the above-mentioned sliding member.

According to the present invention, since the above-mentioned sliding film contains copper-based alloy particles including titanium and has a titanium oxide layer at part of the interface between the particles forming the sliding film, it is possible to provide a sliding member capable of achieving excellent high-temperature wear resistance and an internal combustion engine provided with the sliding member.

BRIEF DESCRIPTION OF THE DRAWINGS

Referring now to the attached drawings which form a part of this original disclosure, selected embodiments are illustrated.

DETAILED DESCRIPTION OF EMBODIMENTS

Figure 1:
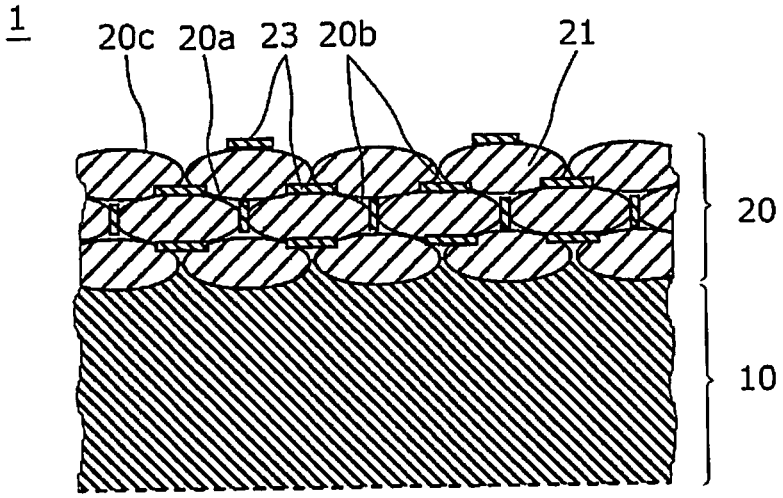
FIG. 1 is a schematic cross section illustrating a first embodiment of the sliding member of the present invention.

The sliding member and internal combustion engine of the present invention are described in detail below with reference to the drawings. The dimensional ratios in the drawings cited below may be exaggerated for explanatory purposes and may differ from actual ratios.

First Embodiment

As shown in FIG. 1, a sliding member 1 in the first embodiment is provided with a base material 10 and a sliding film 20 formed on a surface of the base material 10. The sliding film 20 includes copper-based alloy particles 21 containing titanium as particles constituting the sliding film 20 and has a titanium oxide layer 23 at part of the interface 20*a* between the particles constituting the sliding film 20. The sliding film 20 also has voids 20*b*. It should be noted that the surface 20*c* of the sliding film 20 is, of course, a sliding surface.

In the present invention, the term "copper-based alloy" refers to an alloy containing copper as the main component, the content of which is the highest in mass % among all components. The same applies to iron-based alloys, cobalt-based alloys, molybdenum-based alloys, chromium-based alloys, and nickel-based alloys, each alloy containing its respective metal as the main component, the content of which is highest in mass % among all components.

Further, in the present invention, the "titanium oxide layer" is formed due to the oxidation of titanium contained in copper-based alloy particles present near the surface of the titanium-containing copper-based alloy particles that easily comes into contact with an oxidizing atmosphere such as air. Therefore, copper-based alloy particles containing titanium already have a titanium oxide layer on the surface at the stage of the obtained raw material particles.

The advantages of the present embodiment will now be described. According to the embodiment, the sliding film 20 includes copper-based alloy particles 21 containing titanium and has the titanium oxide layer 23 at part of the interface 20*a* between the particles forming the sliding film 20, and is therefore less likely to soften even at high temperatures, thereby providing excellent high-temperature wear resistance.

Until now, when particles were cold-sprayed onto a base material to form a sliding film on the base material, it was preferable that an oxide film that formed on the particle surface be thin or absent, and that the particles should be plastically deformed and the oxide film destroyed when the particles were cold-sprayed onto the base material, thereby allowing the particles to metallurgically bond to each other.

In contrast, in the present invention, an oxide film is intentionally formed on the particle surface by incorporating titanium, a readily oxidizable metal, into copper. When such titanium-containing copper-based alloy particles are used as raw material particles for cold spray, the relatively soft copper alloy particles plastically deform when cold-sprayed onto the base material, and part of the oxide film is destroyed, allowing the alloy particles to metallurgically bond to each other, while part of the oxide film remains intact. Such oxide films have been thought to hinder the wear resistance improvement effect, but it has been found that, on the contrary, an excellent wear resistance improvement effect can be exhibited at high temperatures.

The currently presumed mechanism for improving high-temperature wear resistance in sliding members will now be explained in detail.

For example, when a sliding film is formed with titanium-containing copper-based alloy particles, the titanium oxide layer that exists at part of the interface between the particles forming the sliding film can be distributed more uniformly in the sliding film compared to the hard particles in the case of a sliding film formed of copper-based alloy particles and hard particles. Therefore, such a titanium oxide layer tends to effectively exhibit a pinning effect against plastic flow in the sliding film, and it is thought to be able to suppress the adhesion of titanium-containing copper-based alloy particles and improve the high-temperature wear resistance of the sliding member.

Further, for example, the above-mentioned titanium oxide layer can be more easily included in larger amounts in the sliding film compared to precipitates contained in copper alloy particles when the sliding film is formed with precipitation-hardened copper alloy particles. Therefore, such a titanium oxide layer tends to effectively exhibit a pinning effect against plastic flow in the sliding film, and is also thought to be able to suppress adhesion of titanium-containing copper-based alloy particles and improve the high-temperature wear resistance of the sliding member.

Moreover, for example, when the sliding member slides, the above-mentioned titanium oxide layer at the interface between particles forming the sliding film tends to alleviate the stress applied to the titanium-containing copper-based alloy particles. Therefore, such a titanium oxide layer tends to suppress the adhesion of titanium-containing copper-based alloy particles and is also thought to be able to enhance the high-temperature wear resistance of the sliding member.

However, it is sufficient if the sliding member of the present invention has the above-mentioned configuration (for example, see paragraph 0015), and it goes without saying that if similar effects are obtained by mechanisms other than those described above, those mechanisms are included within the scope of the present invention.

Further, according to the present embodiment, the titanium oxide itself forming the titanium oxide layer can act as a solid lubricant on the surface side of the sliding film, enhancing the sliding properties of the sliding member, and hence, the wear resistance.

Here, the specifications and materials of each component will be explained in greater detail.

The above-mentioned base material is not particularly limited, and metals conventionally employed for sliding members of internal combustion engines can be used, for example, but aluminum alloys are preferable due to their high thermal conductivity.

Examples of the above-mentioned aluminum alloy include A5056, A1050, AC2A, AC8A, ADC12, AC4CH, etc., as specified by the Japanese Industrial Standards.

The above-mentioned sliding film is preferably formed, for example, from particle aggregates. In the present invention, "particle aggregates" refer particles whose surfaces are partially softened or dissolved, where the contact portions of adjacent particles are solidified and bonded to form a single unit.

Further, the porosity in cross section of the above-mentioned sliding film is preferably 4 area % or less, more preferably 1 area % or less. The strength of the sliding film is improved if the sliding film has few vacancies and is dense, which also improves the high-temperature wear resistance.

The porosity of the above-mentioned sliding film can be calculated, for example, by binarizing a scanning electron micrograph through image processing and image analysis.

Further, it is preferable if the above-mentioned sliding film have at least either amorphous substance or nanocrystals at the interface between particles forming the sliding film. The formation of fine nanocrystals or amorphous substance in the vicinity of the interface between particles can improve the wear resistance of the sliding member.

The amorphous substance or nanocrystals at the interface between particles can be confirmed, for example, by projecting diffraction patterns onto a detector surface through electron backscatter diffraction using a scanning electron microscope and analyzing the crystal orientations from the projected patterns.

Further, the above-mentioned sliding film is preferably formed by spraying and deforming the particles forming the sliding film onto the base material. Forming the sliding film in this way can improve the wear resistance of the sliding member.

The copper-based alloy particles are not particularly limited as long as the particles contain titanium and can exhibit the high-temperature wear resistance improvement effect of the sliding member. For example, the titanium content in the copper-based alloy particles is preferably 1.0 mass % or more and 15.0 mass % or less. If the titanium content in the copper-based alloy particles is less than 1.0 mass %, it may not be possible to form a titanium oxide layer sufficient to adequately improve the high-temperature wear resistance of the sliding member. On the other hand, if the titanium content in the copper-based alloy particles exceeds 11.0 mass %, it may not be possible to disperse titanium uniformly among the copper-based alloy particles. Further, if the titanium content in the copper-based alloy particles exceeds 15.0 mass %, the titanium oxide layer may be formed over the entire interface between the particles constituting the sliding film.

From the standpoint of more reliably improving the high-temperature wear resistance of the sliding member, the titanium content in the copper-based alloy particles is preferably 3.5 mass % or more and 11.0 mass % or less.

In addition, when the titanium content in the copper-based alloy particles exceeds 9.0 mass %, the high-temperature wear resistance improvement effect tends to saturate. Therefore, from the standpoint of effectively dispersing and forming a titanium oxide layer at the interface between the particles forming the sliding film and more reliably improving the high-temperature wear resistance of the sliding member, the titanium content in the copper-based alloy particles is preferably 3.5 mass % or more and 9.0 mass % or less.

Further, from the standpoint of more effectively dispersing and forming a titanium oxide layer at the interface between the particles forming the sliding film and further reliably improving the high-temperature wear resistance of the sliding member, the titanium content in the copper-based alloy particles is preferably 3.5 mass % or more and 8.0 mass % or less.

In addition, from the standpoint of effectively forming a titanium oxide layer that acts as a solid lubricant on the surface side of the sliding film and improving the high-temperature wear resistance of the sliding member, the titanium content in the copper-based alloy particles is preferably 4.0 mass % or more and 10.0 mass % or less.

In particular, from the standpoint of more effectively dispersing and forming a titanium oxide layer at the interface between the particles forming the sliding film, and additionally effectively forming a titanium oxide layer that acts as a solid lubricant on the surface side of the sliding film, thereby further reliably improving the high-temperature wear resistance of the sliding member, the titanium content in the copper-based alloy particles is preferably 4.0 mass % or more and 8.0 mass % or less.

The above-mentioned titanium-containing copper-based alloy particles may contain aluminum. The aluminum content in the titanium-containing copper-based alloy particles is preferably 0.5 mass % or less, for example.

It is preferred that the above-mentioned titanium-containing copper-based alloy contain copper and titanium precipitates. Examples of such precipitates include $Cu_4Ti$. When such precipitates are included in the titanium-containing copper-based alloy particles, the wear resistance of the sliding member can be improved due to precipitation hardening of the alloy particles themselves.

The above-mentioned precipitates can be confirmed by observing a cross section of the titanium-containing copper-based alloy particles using an energy dispersive X-ray analyzer and a transmission electron microscope.

The average particle diameter (circle-equivalent diameter) of the above-mentioned titanium-containing copper-based alloy particles is preferably 20 μm or more and 50 μm or less, and more preferably 20 μm or more and 40 μm or less. If the average particle diameter of the titanium-containing copper-based alloy particles is less than 20 μm or exceeds 50 μm, it may not be possible to form the desired sliding film with good yield.

The average particle diameter (circle-equivalent diameter: the diameter of a circle having the same area as the projected area of the particle image) of the above-mentioned titanium-containing copper-based alloy particles can be calculated by binarizing a scanning electron micrograph through image processing and image analysis.

The above-mentioned titanium oxide layer is not particularly limited as long as the layer can exhibit the above-mentioned high-temperature wear resistance improvement effect of the sliding member. In addition, the titanium oxide layer is not formed separately on the surface of the copper-based alloy particles, but rather, as described above, is formed due to the oxidation of the titanium that is present near the surface of the titanium-containing copper-based alloy particles and that easily comes in contact with an oxidizing atmospheres such as air. Such a titanium oxide layer appears linear in a cross section of the sliding film. The length of the linear titanium oxide layer depends on the size of the titanium-containing copper-based alloy particles, but is preferably 10 μm or more and 40 μm or less, and more preferably 15 μm or more and 35 μm or less. The width of the linear titanium oxide layer is preferably 0.05 μm or more and 2 μm or less, and more preferably 0.1 μm or more and 1 μm or less. If the length of the titanium oxide layer is less than 10 μm or the width is less than 0.05 μm, the effect of improving high-temperature wear resistance may be attenuated. If the length of the titanium oxide layer exceeds 40 μm or the width exceeds 2 μm, it may not be possible to form the desired sliding film with good yield.

The above-described titanium oxide layer can be confirmed by observation of a cross section of the sliding film using a scanning electron microscope and an energy dispersive X-ray analyzer.

Figure 2:
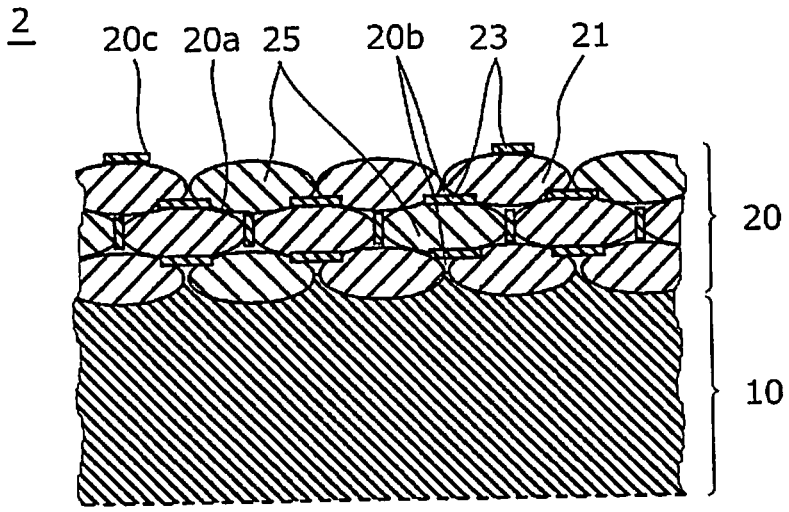
FIG. 2 is a schematic cross section illustrating a second embodiment of the sliding member of the present invention.

FIG. 2 is a diagram illustrating a second embodiment of the sliding member of the present invention. In the following embodiment, the same structural parts as those in the first embodiment have been assigned the same reference numerals, and the corresponding detailed explanations are omitted.

Second Embodiment

As shown in FIG. 2, the sliding member 2 of the second embodiment has the same structure as the sliding member 1 of the first embodiment except that the sliding film 20 also includes metal particles 25 and/or ceramic particles 25 containing at least one metal selected from the group consisting of iron, cobalt, molybdenum, chromium, and nickel.

The advantages of this embodiment will now be described. According to the present embodiment, since the sliding film 20 also includes metal particles 25 and/or ceramic particles 25 containing at least one metal selected from the group consisting of iron, cobalt, molybdenum, chromium, and nickel, in addition to the advantages of the first embodiment, better high-temperature wear resistance can be achieved, and thermal conductivity can be further ensured.

The metal particles and ceramic particles are not particularly limited, but it is preferable that these particles be harder than, for example, the above-mentioned titanium-containing copper-based alloy particles.

Examples of the metal particles include single-metal particles or alloy particles containing iron, cobalt, molybdenum, chromium or nickel. Examples of the alloy particles include iron-based alloy particles, cobalt-based alloy particles, molybdenum-based alloy particles, chromium-based alloy it particles, and nickel-based alloy particles. Of these, cobalt-based alloy particles that have excellent wear resistance are preferable, specifically, Co-28Mo-8Cr-2.5Si.

Examples of the ceramic particles include tungsten carbide particles and alumina particles.

The average particle diameter (circle-equivalent diameter) of the metal particles or ceramic particles is preferably 5 μm or more and 40 μm or less, and more preferably 10 μm or more and 30 μm or less. If the average particle diameter of the metal particles or ceramic particles is less than 5 μm or more than 40 μm, it may not be possible to form the desired sliding film with good yield.

The average particle diameter (circle-equivalent diameter: diameter of a circle having the same area as the projected area of the particle image) of the metal particles or ceramic particles can be calculated by binarizing a scanning electron micrograph through image processing and image analysis.

Method for Manufacturing the Sliding Member

The above-mentioned sliding member can be produced by forming a sliding film on a base material surface, for example, by cold spraying raw material particles containing the above-mentioned titanium-containing copper-based alloy particles and the above-mentioned metal particles and ceramic particles, which have been added as needed, onto the base material surface in an unmelted state.

In the titanium-containing copper-based alloy particles in the raw material particles, it is preferable that the oxygen content, including the titanium oxide layer on the particle surface, be 0.1 mass % or more and 2.0 mass % or less, and more preferably 0.25 mass % or more and 0.8 mass % or less. If the oxygen content in the titanium-containing copper-based alloy particles in the raw material particles is less than 0.1 mass %, it may not be possible to form the desired sliding film with good yield. On the other hand, if the oxygen content in the titanium-containing copper-based alloy particles in the raw material particles exceeds 2.0 mass %, it becomes difficult to manufacture the titanium-containing copper-based alloy particles themselves.

The content of the metal particles and the ceramic particles in the raw material particles is preferably 50 mass % or less. Within this range, the content ratio of titanium-containing copper-based alloy particles can be ensured, and the thermal conductivity of the sliding member can be ensured.

Cold spraying is a method in which raw material particles are collided with a base material in an unmelted solid phase state, in a supersonic flow together with an inert gas to form a film of particle aggregates without melting or vaporizing the particles.

The raw material particles can be produced by various methods. However, from the standpoint of easily obtaining the raw material particles as solid solution particles, for example, a water or gas atomizing method, in which water or gas is blown onto a melted titanium-containing copper-based and the fine droplets are solidified to form particles, is preferred; and in order to obtain the desired amount of oxygen in the powder immediately after atomization, the water atomizing method is preferred.

In cold spraying, when the titanium-containing copper-based alloy particles are solid solution particles, the titanium-containing copper-based alloy particles in the solid phase state have not yet undergone precipitation hardening before colliding with the base material; therefore, the titanium-containing copper-based alloy particles plastically deform to absorb the stress of the collision, thereby preventing the titanium-containing copper-based alloy particles from cracking or rebounding.

In addition, within the titanium-containing copper-based alloy particles, the copper and titanium, which are solid-soluble components, precipitate as compounds such as CuTi due to the energy of collision, forming crystallites with an average particle size of 5 to 50 nm, for example, and the titanium-containing copper-based alloy particles become precipitation-hardened copper-based alloy particles, thereby improving the wear resistance.

Part of the kinetic energy is then converted into thermal energy due to the collision of the raw material particles, and the surface of the raw material particles locally melts and solidifies, causing the raw material particles to bond to each other and forming particle aggregates containing titanium-containing copper-based alloy particles, as well as metal and ceramic particles, added as necessary, in a dispersed state.

At this time, since the surface of the raw material particles melts locally, diffusion occurs, resulting in the formation of precipitates such as intermetallic compounds. However, since the temperature of the base material and the raw material particles is below the melting point of the above-mentioned raw material particles, the above-mentioned locally melted areas rapidly cool, so that there is no time for crystal growth of the precipitates.

Therefore, nanocrystals and amorphous substances are formed at the vicinity of the interface where the base material and particles are bonded, and near the interface where particles are bonded to each other.

The velocity at which the raw material particles are sprayed is preferably 300 to 1200 m/s, and more preferably 500 to 1200 m/s.

Further, the pressure of the working gas used to spray the raw material particles is preferably 2 to 7 MPa, and more preferably 3.5 to 7 MPa. If the pressure of the working gas is less than 2 MPa, sufficient particle velocity may not be obtained, and the porosity may increase.

The temperature of the working gas, depending on the type and particle size of the raw material particles, is preferably 400 to 1000° C., and more preferably 600 to 1000° C. If the temperature of the working gas is less than 400° C., it may be difficult for the raw material particles to deform plastically, resulting in high porosity and decreased wear resistance. If the temperature of the working gas exceeds 1000° C., this temperature will be too close to the melting point of the raw material particles, and the throat of the spray nozzle may easily become clogged.

Examples of the working gas include nitrogen gas and helium gas, which may be used individually or as a mixture.

The thickness of the sliding film depends on the temperature and sliding environment of the location where the sliding member is used, but it is preferably 0.05 mm or more and 5.0 mm or less, and more preferably 0.1 mm or more and 0.5 mm or less. If the thickness of the sliding film is less than 0.05 mm, the strength of the sliding film itself may be insufficient, and plastic deformation may occur if the strength of the base material is low. If the thickness of the sliding film exceeds 5.0 mm, the sliding film may easily peel off from the base material due to the relationship between the residual stress generated during the formation of the sliding film and the interfacial adhesion strength.

Figure 3:
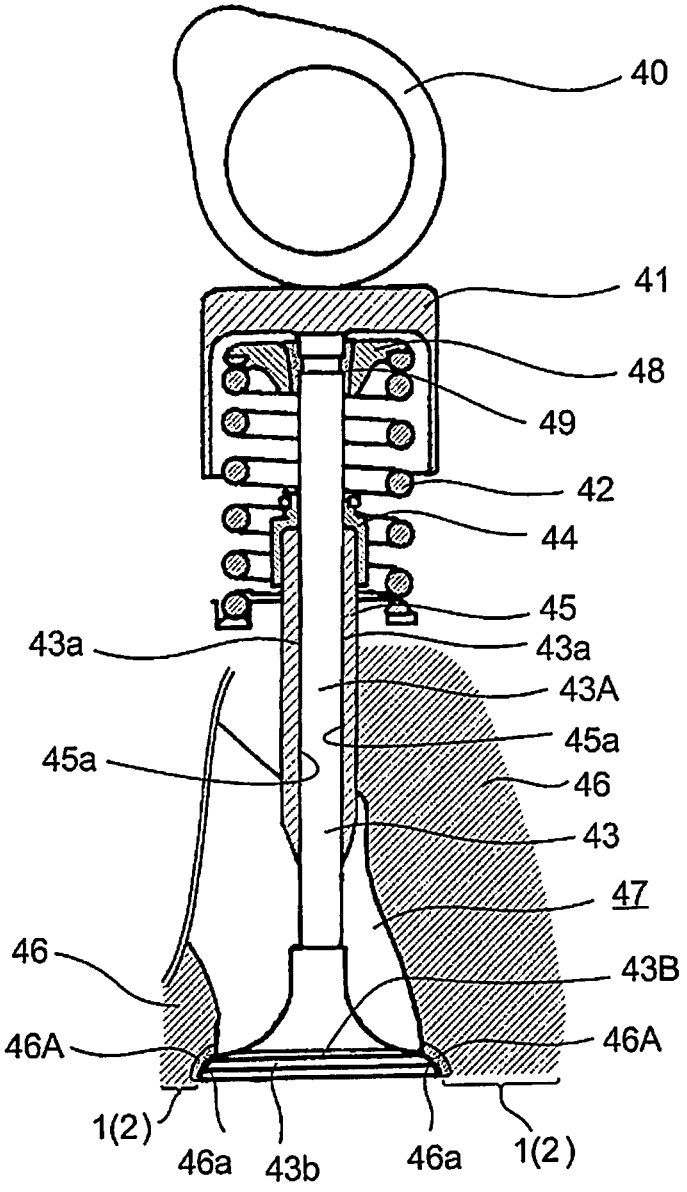
FIG. 3 is a schematic partial cross section illustrating part of an embodiment of the internal combustion engine of the present invention.

FIG. 3 is a partial cross section schematically illustrating part of an embodiment of the internal combustion engine of the present invention. More specifically, this figure is a partial cross section schematically illustrating a valve train mechanism that includes an engine valve. In the following embodiment, the same structural parts as those in the first embodiment or the second embodiment have been assigned the same reference numerals, and the corresponding detailed explanations are omitted.

As shown in FIG. 3, when a cam lobe 40 rotates, a valve lifter 41 is pushed down while compressing a valve spring 42, and at the same time an engine valve 43 is pushed down, guided by a valve guide 45 having a stem seal 44, causing the engine valve 43 to separate from the valve seat 46A of the engine valve 43 in the cylinder head 46, and connecting an exhaust port 47 with a combustion chamber, not shown (valve open state). Then, as the cam lobe 40 rotates further, the engine valve 43 is pushed up together with the valve lifter 41, a retainer 48, and a cotter 49 by the repulsive force of the valve spring 42, and the engine valve 43 contacts the valve seat 46A, blocking the exhaust port 47 from the combustion chamber not shown in the drawings (valve closed state). This opening and closing of the engine valve 43 occurs synchronously with the rotation of the cam lobe 40. The valve stem 43A of the engine valve 43 passes through the valve guide 45, which is press-fitted into the cylinder head 46 side, and is installed while being lubricated with oil. In addition, the valve face 43B of the engine valve 43, which corresponds to the opening and closing valve portion of the combustion chamber, not shown, is in contact or non-contact with the valve seat 46A in the cylinder head 46 during operation. Although FIG. 3 shows the exhaust port 47 side, the sliding member of the present invention can also be applied to the intake port side, not shown.

A sliding member provided with the above-mentioned sliding film, for example, a sliding member (1 or 2) of the first or second embodiment described above, is applied to the sliding surface 46*a* of the valve seat 46A of the engine valve in the cylinder head, which is the sliding part of the cylinder head and engine valve. It is thereby possible to improve the high-temperature wear resistance of the internal combustion engine. Further, the internal combustion engine of the present invention makes it possible to eliminate press-fit valve seats. As a result, greater flexibility can be achieved with respect to the shape of the exhaust and intake ports and to enlarging the diameter of engine valves, thereby making it possible to improve fuel efficiency, power output, torque, etc., of the engine.

EXAMPLES

The present invention will be described in further detail below with reference to examples, but the present invention is not limited to these examples.

Comparative Example 1

Using the nickel- and silicon-containing copper-based alloy particles shown in Table 1 (composition: Cu-3Ni-0.7Si, particle size ($D_{50}$): 32.2 μm) as raw material particles, cold spraying was performed under the following conditions to form a sliding film on the surface of an aluminum alloy base material to obtain the sliding member of this example. For the formation of the sliding film on the surface of the aluminum alloy base material for a one-piece valve seat tapping wear test, a sliding film with a thickness of 0.4 to 0.5 mm was formed on the base material and then machined for finishing into the shape of a valve seat of an engine valve in an actual cylinder head. The particle size of the raw material particles ($D_{50}$, median diameter) was measured as the diameter at 50% cumulative frequency of the volume distribution measured by the laser diffraction/scattering method using a particle size distribution measuring device, Microtrac MT3000EXII manufactured by Microtrac Bell Co., Ltd.

| | |
|---|---|
| Cold spray device | PCS-1000 manufactured by Plasma Giken Co., Ltd. |
| Working gas | Nitrogen |
| Working gas temperature | 600° C. |
| Working gas pressure | 4 MPa |
| Spray distance | 20 mm |
| Aluminum alloy base material | Material-A1050 as specified in Japanese Industrial Standards; Size-100 × 100 × 5 mm (for Vickers hardness test) Material-A5056 as specified in Japanese Industrial |
| Base material rotation speed | 300 rpm |
| Gun traverse speed | About 100 mm/s |
| Raw material particle feed rate | About 7 g/min |

Standards; Size—Pre-processed aluminum alloy base material prepared by pre-processing of the aluminum alloy base material assuming a target sliding film thickness of 0.2 mm in the finished machining state of the valve seat of the engine valve in the cylinder head (for one-piece valve seat tapping wear test).

Comparative Example 2

The sliding member of this example was obtained by repeating the same operation as in Comparative Example 1, except that the nickel-, cobalt-, and silicon-containing copper-based alloy particles (composition: Cu-1.5Ni-1.5Co-0.7Si, particle size ($D_{50}$): 31.7 μm) shown in Table 1 were used instead of the nickel- and silicon-containing copper-based alloy particles used in Comparative Example 1.

Comparative Example 3

The sliding member of this example was obtained by repeating the same operation as in Comparative Example 1, except that nickel-, cobalt-, and silicon-containing copper-based alloy particles (composition: Cu-2.2Ni-0.8Co-0.7Si, particle size ($D_{50}$): 30.6 μm) shown in Table 1 were used instead of the nickel- and silicon-containing copper-based alloy particles used in Comparative Example 1.

Comparative Example 4

The sliding member of this example was obtained by repeating the same operation as in Comparative Example 1, except that the iron- and silicon-containing copper-based alloy particles (composition: Cu-3Fe-0.7Si, particle size ($D_{50}$): 32.2 μm) shown in Table 1 were used instead of the nickel- and silicon-containing copper-based alloy particles used in Comparative Example 1.

Example 1

Figure 4:
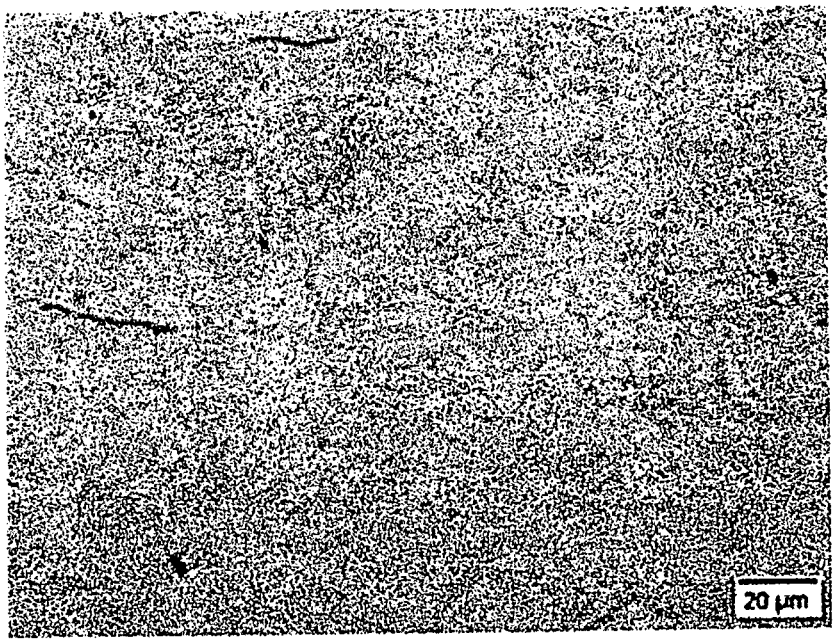
FIG. 4 is a scanning electron micrograph of a cross section of the sliding film in Example 1.

The sliding member of this example was obtained by repeating the same operations as in Comparative Example 1, except that the titanium-containing copper-based alloy particles (composition: Cu-3.6Ti, particle size ($D_{50}$): 33.2 μm) shown in Table 1 were use instead of the nickel- and silicon-containing copper-based alloy particles used in Comparative Example 1. FIG. 4 is a scanning electron micrograph cross section of the sliding film in this example.

Example 2

The sliding member of this example was obtained by repeating the same operations as in Comparative Example 1 except that the titanium-containing copper-based alloy particles (composition: Cu-5.3Ti, particle size ($D_{50}$): 29.2 μm) shown in Table 1 were used instead of the nickel- and silicon-containing copper-based alloy particles used in Comparative Example 1.

Example 3

The sliding member of this example was obtained by repeating the same operations as in Comparative Example 1 except that the titanium-containing copper-based alloy particles (composition: Cu-8.3Ti, particle size ($D_{50}$): 31.1 μm) shown in Table 1 were used instead of the nickel- and silicon-containing copper-based alloy particles used in Comparative Example 1.

Example 4

The sliding member of this example was obtained by repeating the same operations as in Comparative Example 1 except that the titanium-containing copper-based alloy particles (composition: Cu-10.4Ti, particle size ($D_{50}$): 29.9 μm) shown in Table 1 were used instead of the nickel- and silicon-containing copper-based alloy particles used in Comparative Example 1.

Comparative Example 5

The sliding member of this example was obtained by repeating the same operations as in Comparative Example 1 except that the nickel- and silicon-containing copper-based alloy particles (composition: Cu-2.5Ni-0.7Si, particle size ($D_{50}$): 33.1 μm) and cobalt-based alloy particles (composition: Co-28Mo-8Cr-2.5Si, particle size ($D_{50}$): 18.2 μm) shown in Table 1, in a blending ratio (mass ratio) of 50:50, were used instead of the nickel- and silicon-containing copper-based alloy particles used in Comparative Example 1.

Comparative Example 6

The sliding member of this example was obtained by repeating the same operations as in Comparative Example 1 except that the nickel-silicon-containing copper-based alloy particles (composition: Cu-3.5Ni-0.7Si, particle size ($D_{50}$): 32.9 μm) and cobalt-based alloy particles (composition: Co-28Mo-8Cr-2.5Si, particle size ($D_{50}$): 18.2 μm) shown in Table 1, in a blending ratio (mass ratio) of 50:50, were used instead of the nickel- and silicon-containing copper-based alloy particles used in Comparative Example 1.

Example 5

The sliding member of this example was obtained by repeating the same operations as in Comparative Example 1 except that titanium-containing copper-based alloy particles (composition: Cu-3.6Ti, particle size ($D_{50}$): 33.2 μm) and cobalt-based alloy particles (composition: Co-28Mo-8Cr-2.5Si, particle size ($D_{50}$): 18.2 μm) shown in Table 1, in a blending ratio (mass ratio) of 50:50, were used instead of the nickel- and silicon-containing copper-based alloy particles used in Comparative Example 1.

TABLE 1

| | Comp. Ex. 1 | Comp. Ex. 2 | Comp. Ex. 3 | Ex. 4 | Ex. 1 | Ex. 2 |
|---|---|---|---|---|---|---|
| Copper-based alloy particles | Cu—3Ni—0.7Si | Cu—1.5Ni—1.5Co—0.7Si | Cu—2.2Ni—0.8Co—0.7Si | Cu—3Fe—0.7Si | Cu—3.6Ti | Cu—5.3Ti |
| Single-metal particles/alloy particles/ceramic particles | — | — | — | — | — | — |
| Presence or absence of titanium oxide layer | Absent | Absent | Absent | Absent | Present | Present |
| Presence or absence of precipitates of copper and titanium | Absent | Absent | Absent | Absent | Present | Present |
| Area ratio of metal particles/alloy particles/ceramic particles in sliding film cross section (area %) | — | — | — | — | — | — |
| Porosity in sliding film cross section (area %) | 0.25 | 0.12 | 0.23 | 0.35 | 0.23 | 0.14 |
| Vickers hardness (Hv) | | | | | | |
| 20° C. | 205 | 203 | 201 | 198 | 210 | 215 |
| 200° C. | 158 | 161 | 160 | 146 | 167 | 158 |
| 300° C. | 116 | 110 | 113 | 105 | 140 | 132 |
| 400° C. | 64.1 | 65.2 | 67.4 | 58.3 | 111 | 96.7 |
| Valve seat wear amount (μm) | 136 | 122.7 | 93.8 | 136.4 | 78.5 | 34.3 |

| | Ex. 3 | Ex. 4 | Comp. Ex 5 | Comp. Ex 6 | Ex. 5 |
|---|---|---|---|---|---|
| Copper-based alloy particles | Cu—8.3Ti | Cu—10.4Ti | Cu—2.5Ni—0.7Si | Cu—3.5Ni—0.7Si | Cu—3.6Ti |
| Single-metal particles/alloy particles/ceramic particles | — | — | Co—28Mo—BCr—2.5Si | Co—28Mo—8Cr—2.5Si | Co—28Mo—8Cr—2.5Si |
| Presence or absence of titanium oxide layer | Present | Present | Absent | Absent | Present |
| Presence or absence of precipitates of copper and titanium | Present | Present | Absent | Absent | Present |
| Area ratio of metal particles/alloy particles/ceramic particles in sliding film cross section (area %) | — | — | 11.2 | 10.8 | 10.5 |
| Porosity in sliding film cross section (area %) | 0.19 | 0.35 | 0.15 | 0.25 | 0.32 |

TABLE 1-continued

| | Vickers hardness (Hv) | | | | |
|---|---|---|---|---|---|
| 20° C. | 222 | 225 | 195 | 217 | 212 |
| 200° C. | 168 | 172 | 152 | 163 | 172 |
| 300° C. | 142 | 145 | 110 | 119 | 154 |
| 400° C. | 104 | 108 | 62.1 | 71.2 | 116 |
| Valve seat wear amount (μm) | 80.9 | 84.3 | 52.0 | 26.1 | 24.8 |

The presence or absence of a titanium oxide layer was confirmed by observing cross sections of the sliding films of each example using a scanning electron microscope and energy dispersive X-ray analyzer. The results obtained are shown in Table 1.

The presence or absence of copper and titanium precipitates (such as $Cu_4Ti$) was confirmed by observing cross sections of the copper-based alloy particles of each example using an energy dispersive X-ray analyzer and transmission electron microscope. The results obtained are shown in Table 1.

For the sliding films of each example, 5 fields of view were photographed in a scanning electron microscope image field having a view range of 350 μm horizontally×263 μm vertically on the cross-section, binarization was performed using an image processing device, and the porosity was calculated. In addition, the area ratios of single-metal particles/alloy particles/ceramic particles were calculated from the same images, and the area ratio of the matrix material particles was obtained as the remainder. The results obtained are shown in Table 1.

(Presence or Absence of Amorphous Substance or Nanocrystals)

For the sliding films of each example, electron backscatter diffraction patterns were projected onto a detector surface using a scanning electron microscope, and the crystal orientation was analyzed from the projected patterns to confirm the presence or absence of amorphous substance or nanocrystals at the interface between particles. The presence of amorphous substance or nanocrystals was confirmed in the sliding films of each example.

The performance of each of the above-mentioned examples of the sliding members was evaluated under the following conditions. The results obtained are shown in Table 1.

| (Vickers hardness test) | |
|---|---|
| Test piece shape | 5 × 5 × 10 mm |
| Measurement temperature | 20° C., 200° C., 300° C., 400° C. |
| Number of measurement points | 5 points |
| Measurement load | 500 gf |
| The average value of the Vickers hardness of the 5 points measured under these conditions was calculated. | |

| (One-piece valve seat tapping wear test) | |
|---|---|
| Equipment | One-piece valve seat tapping wear tester (manufactured Takachiho Seiki Co., Ltd.) |
| Test temperature | 300° C. |
| Number of seating cycles | 540,000 (3000 cpm × 3 hr) |
| Evaluation item | Valve seat wear amount (shape measurement) |

From Table 1, it can be seen that the Vickers hardness at high temperatures (300° C., 400° C.) of the sliding members of Examples 1-5, which fall within the scope of the present invention, is higher than the Vickers hardness at high temperatures of the sliding members of Comparative Examples 1-6, which are outside the scope of the present invention. Therefore, from Table 1, it can be seen that the sliding members of Examples 1-4, which fall within the scope of the present invention and do not contain any single-metal particles, alloy particles, or ceramic particles, have better high-temperature wear resistance compared to the sliding members of Comparative Examples 1-4, which are outside the scope of the present invention and do not contain any single-metal particles, alloy particles, or ceramic particles. Further, from Table 1, it can be seen that the sliding member of Example 5, which contains alloy particles and falls within the scope of the present invention, has better high-temperature wear resistance compared to the sliding members of Comparative Examples 5 and 6, which contain alloy particles and are outside the scope of the present invention.

It is thought that the sliding members of the present invention have superior high-temperature wear resistance because, as shown in FIG. 4, the above-mentioned sliding film includes copper-based alloy particles containing titanium, and contains a linear titanium oxide layer at some of the interfaces between the particles forming the sliding film.

It is also thought that the sliding members of the present invention have superior high-temperature wear resistance because the titanium content in the copper-based alloy particles is 3.5 mass % or more and 11.0 mass % or less.

Further, it is thought that the sliding members of the present invention have superior high-temperature wear resistance because the copper-based alloy particles contain precipitates consisting of copper and titanium.

It is also thought that the sliding members of the present invention have superior high-temperature wear resistance because the sliding film contains the above-mentioned specific metal particles.

While the present invention has been described by means of several embodiments, the invention is not limited to these embodiments, and various modifications are possible within the scope of the essence of the present invention. For example, the components described are not limited to those shown in each embodiment, and it is possible to change the details of the specifications of the copper-based alloy particles, metal particles, ceramic particles, and sliding film, or to apply components from one embodiment to other embodiments.

For instance, although the sliding members in the above-described embodiments were explained using examples in which the sliding film was formed on the surface of a base material, in the sliding members of the present invention, the entire sliding member may be formed of the above-mentioned sliding film.

In addition, for example, although the internal combustion engine in the above-described embodiments was explained using examples in which the sliding member was provided at the seating part (valve seat) of the engine valve, the internal combustion engine of the present invention could be equipped with sliding members at one or more of the following locations: the valve faces, valve stems, valve guides, valve lifters, pistons, piston rings, piston pins, cylinders, crankshaft, camshafts, and connecting rods.

The invention claimed is:

1. An internal combustion engine comprising a sliding member, the sliding member comprising:

a sliding film at least on a surface thereof, wherein the sliding film contains copper-based alloy particles including titanium and has a titanium oxide layer at part of the interface between the particles forming the sliding film, and a titanium content of the copper-based alloy particles is 3.5 mass % or more and 11.0 mass % or less.

2. The internal combustion engine according to claim 1, wherein the titanium content of the copper-based alloy particles is 3.5 mass % or more and 9.0 mass % or less.

3. The internal combustion engine according to claim 1, wherein the copper-based alloy particles contain precipitates consisting of copper and titanium.

4. The internal combustion engine according to claim 1, wherein the sliding film contains metal particles containing at least one metal selected from a group consisting of iron, cobalt, molybdenum, chromium and nickel, and/or ceramic particles.

5. The internal combustion engine according to claim 1, wherein the porosity in a cross section of the sliding film is 4 area % or less.

6. The internal combustion engine according to claim 1, wherein the sliding film has at least one of amorphous substance and nanocrystals at interfaces between particles forming the sliding film.

7. The internal combustion engine according to claim 1, comprising a base material, wherein the sliding film is formed on the base material.

8. The internal combustion engine according to claim 7, wherein the sliding film is formed by spraying particles that make up the sliding film onto the base material, which deform upon being sprayed.

* * * * *